US010787800B2

(12) United States Patent
Boyes et al.

(10) Patent No.: US 10,787,800 B2
(45) Date of Patent: Sep. 29, 2020

(54) APPARATUS FOR FLUSHING A TOILET, COMPRISING AN ACCUMULATOR

(71) Applicant: THOMAS DUDLEY LIMITED, Birmingham, West Midlands (GB)

(72) Inventors: Simon Boyes, Birmingham (GB); Martin Dudley, Birmingham (GB); Andrew Holmes, Birmingham (GB)

(73) Assignee: THOMAS DUDLEY LIMITED, Birmingham West Midlands (GB)

( * ) Notice: Subject to any disclaimer, the term of this patent is extended or adjusted under 35 U.S.C. 154(b) by 71 days.

(21) Appl. No.: 16/072,497

(22) PCT Filed: Feb. 3, 2017

(86) PCT No.: PCT/GB2017/050267
§ 371 (c)(1),
(2) Date: Jul. 24, 2018

(87) PCT Pub. No.: WO2017/134448
PCT Pub. Date: Aug. 10, 2017

(65) Prior Publication Data

US 2019/0032316 A1 Jan. 31, 2019

(30) Foreign Application Priority Data

Feb. 4, 2016 (GB) ..... 1602014.1

(51) Int. Cl.

| | |
|---|---|
| ***E03D 5/02*** | (2006.01) |
| ***E03D 1/08*** | (2006.01) |
| ***E03D 1/14*** | (2006.01) |
| ***E03D 3/10*** | (2006.01) |

(52) U.S. Cl.
CPC ..... *E03D 5/024* (2013.01); *E03D 1/087* (2013.01); *E03D 1/141* (2013.01); *E03D 3/10* (2013.01)

(58) Field of Classification Search
CPC ..... E03D 5/024; E03D 1/087; E03D 1/141; E03D 3/10
USPC ..... 4/407
See application file for complete search history.

(56) References Cited

U.S. PATENT DOCUMENTS

| | | | | |
|---|---|---|---|---|
| 4,142,262 A | | 3/1979 | Hamilton | |
| 5,241,711 A | | 9/1993 | Badders | |
| 5,361,426 A | * | 11/1994 | Martin | E03D 3/04 251/41 |

(Continued)

FOREIGN PATENT DOCUMENTS

| | | |
|---|---|---|
| GB | 2277750 A | 11/1994 |
| WO | 0050700 A1 | 8/2000 |

(Continued)

*Primary Examiner* — Christine J Skubinna
(74) *Attorney, Agent, or Firm* — Donald E. Stout; Stout, Uxa & Buyan, LLP

(57) ABSTRACT

A flushing apparatus (1, 301) for being installed in the cistern of a toilet including a flushing device (2) for fluid connection with an outlet of a cistern and a hydraulically-driven control circuit (3, 303) for operating the flushing device. The control circuit (3, 303) includes a water inlet (P) for fluidly connecting the control circuit (3, 303) to a source of pressurised water and an accumulator (6) fluidly connected to the water inlet (P) and configured to supplement, in use, the flow of pressurised water supplied by the source trough the control circuit (3, 303) to activate the flushing device (2).

15 Claims, 12 Drawing Sheets

(56) References Cited

U.S. PATENT DOCUMENTS

| | | | | |
|---|---|---|---|---|
| 6,029,287 | A | 2/2000 | Ge et al. | |
| 2005/0150038 | A1* | 7/2005 | Li | E03D 3/04 4/354 |
| 2009/0144889 | A1 | 6/2009 | Hennessay | |

FOREIGN PATENT DOCUMENTS

| | | | |
|---|---|---|---|
| WO | 0242670 | A2 | 5/2002 |
| WO | 2015036767 | A1 | 3/2015 |

* cited by examiner

APPARATUS FOR FLUSHING A TOILET, COMPRISING AN ACCUMULATOR

This invention relates generally to accumulators. More specifically, although not exclusively, this invention relates to accumulators for control and supply circuits for hydraulic devices used for controlling the discharging and/or refilling of toilet cisterns and/or for clearing drains.

Toilet cisterns generally include a flushing device for discharging the contents of the cistern and a filling device for refilling the cistern following a flushing cycle. The flushing device is normally mounted to obstruct an outlet of the cistern that feeds a toilet pan and configured to selectively allow fluid flow therethrough to flush waste out of the pan. The filling device is normally connected to a mains water supply or header tank for introducing replacement water into the cistern.

The flushing device can be operated manually, for example using a mechanical actuator in the form of a lever or push button, or automatically, for example using an electromechanical actuation system. Manually operated flushing devices require a predetermined amount of force to unseat a valve member, or to initiate a syphonic action in the case of syphon flushing devices. Recent developments aimed at reducing the force required to operate flushing device actuators have utilised mains water pressure to complement or replace the initiation force required with purely mechanical solutions. The use of mains water pressure also precludes the need for an electrical power supply.

WO2015036767, the contents of which are incorporated herein by reference, describes a flushing syphon that incorporates an actuator piston secured to the piston rod of a syphon-initiating piston. The actuator piston is reciprocable within a cylinder having an inlet into which mains water pressure is selectively introduced to move the piston in order to initiate syphonic action, thereby emptying the contents of the cistern. Mains water is supplied to the actuator cylinder and is controlled by an in-line operating valve that is operated by a pilot valve incorporated in an operator actuated push button.

It would be desirable to provide a solution that is simpler and more adaptable to domestic installations. The characteristics of water supply systems, including pipes, plumbing system design and cistern characteristics can vary widely between installations. It is therefore a non-exclusive aim of the invention to provide a cistern flushing apparatus and associated control circuit that improves the adaptability and simplicity of known installations.

It is a further, more general non-exclusive aim of the invention to provide an improved cistern flushing apparatus and associated control circuit.

Accordingly, a first aspect of the invention provides a cistern flushing apparatus comprising a flushing device for fluid connection with an outlet of a cistern and a control circuit for operating the flushing device, the control circuit comprising an inlet for connecting the control circuit to a source and an accumulator fluidly connected to the inlet and configured to supplement, in use, a flow supplied by the source to or through the control circuit.

Thus, variations in pressure and/or flow caused by restrictions within the installation or any fluctuations in supply, whether from the source or from usage in other parts of the installation, can be mitigated. This is due to the fact that pressurised fluid introduced into the accumulator from the source compresses air within the container to provide a pressurised store of water.

The apparatus or control circuit may comprise a power-driven, e.g. fluid-power-driven, control circuit. Preferably, the control circuit comprises a hydraulically-driven control circuit. The inlet may be for connecting to a source of power, e.g. for fluidly connecting the control circuit to a source of pressurised fluid such as air but preferably water. The accumulator may be fluidly connected to the inlet and configured to supplement, in use, the flow of pressurised water supplied by the source to the control circuit.

Another aspect of the invention provides a fluid supply control circuit comprising a fluid inlet, e.g. for fluid connection with a source of pressurised fluid, a fluid outlet, e.g. for supplying pressurised fluid to a fluidic device, an operating valve fluidly connected between the fluid inlet and the fluid outlet, e.g. for selectively opening fluid communication therebetween, and an accumulator fluidly connected between the operating valve and the fluid inlet, wherein the accumulator is configured to supplement, in use, the flow of pressurised fluid supplied by the source to the fluid outlet.

Yet another aspect of the invention provides an accumulator. The accumulator may comprise an inlet, e.g. a fluid inlet, which may be for fluid connection with a source of pressurised fluid, e.g. water. The inlet of the accumulator may correspond to or be for fluid connection with the fluid inlet of the control circuit. The accumulator may comprise an outlet, e.g. a fluid outlet, which may correspond to or be for fluid connection with the fluid outlet of the control circuit. The fluid outlet may be for fluid connection with a fluidic device or the operating valve of the control circuit.

The control circuit and/or accumulator may comprise a second outlet, which may be a fluid outlet. The second outlet may be for fluid connection with a fluidic device, e.g. a further fluidic device. The second outlet may bypass or be configured, in use, to bypass the operating valve.

The fluid may comprise a hydraulic fluid, e.g. water. The or at least one or each fluidic device may comprise a hydraulic device. The hydraulic device may comprise a flushing device, e.g. for emptying a cistern. The further hydraulic device may comprise a filling device, e.g. for filling a cistern. At least one of the hydraulic devices may comprise a jetting device, e.g. for clearing drains.

The apparatus, control circuit or accumulator may comprise an air inlet and/or venturi means, e.g. for introducing, in use, air into the accumulator. The venturi means may comprise a venturi and/or may be downstream of the inlet or fluid inlet of the apparatus, control circuit and/or upstream of the inlet or fluid inlet of the accumulator. The venturi means may be in fluid communication with the air inlet, e.g. for entraining air from the air inlet into the accumulator.

The applicants have observed that, over time, air in the accumulator may become depleted. Whilst not wishing to be bound by any theory, this is believed to be caused by one or both of the air dissolving into the water within the accumulator and/or permeating through the wall of the accumulator. By regularly reintroducing air into the accumulator, this phenomenon is mitigated.

As used herein, the terms upstream and downstream refer to locations within the apparatus, circuit or accumulator relative to the direction of flow, in use, therethrough.

The apparatus, control circuit or accumulator may comprise an air inlet passageway, passage, tube or pipe, which may extend from the air inlet and/or to or toward the venturi means. The apparatus, control circuit or accumulator may comprise an inlet tube, e.g. a fluid or water inlet tube, which may be in fluid communication with the inlet or fluid or water inlet. The inlet tube may comprise a restriction, constriction or reduction in internal diameter, which may provide, at least in part, the venturi means. The inlet tube may extend into a base of the accumulator.

At least one of the outlet(s) of the apparatus, control circuit or accumulator may be in fluid communication with the or a base of the accumulator, e.g. a sump therein. In embodiments, a water outlet passageway, passage, tube or pipe is provided, which may be in fluid communication with the sump of base of the accumulator. The base of the accumulator may comprise an upper portion or intended upper portion of the accumulator. Preferably, the base of the accumulator comprises a lower portion or intended lower portion of the accumulator.

In embodiments, the outlet(s) or the outlet passageway, passage, tube or pipe is or are located at and/or extend from an upper portion or intended upper portion of the accumulator. The accumulator outlet passageway, passage, tube or pipe may extend into a lower portion of the accumulator, for example such that pressurised air within the accumulator and/or water introduced, in use, through the inlet or inlet pipe into the accumulator forces water out of the outlet(s) or outlet pipe, e.g. and to or toward the actuator of a cistern flushing device and/or to or toward a cistern filling device.

The apparatus, control circuit or accumulator may comprise a non-return or one-way means, e.g. valve means. The non-return or one-way means may be associated with the air inlet, e.g. for allowing air to enter, in use, into the control circuit and/or inhibiting water egress from the control circuit.

The control circuit or accumulator may be for a drain clearing device. Indeed, the control circuit or accumulator may be for any device requiring the flow from a fluid source to be supplemented.

The apparatus or control circuit may comprise an actuator. The actuator may comprise a hydraulically-driven actuator, which may be operatively connected to or comprised or incorporated in, e.g. integral with, the flushing device. The actuator may be for operating, or configured to operate, the flushing device. The control circuit may comprise an operating valve, which may be between the actuator and the inlet and/or the accumulator, e.g. for selectively opening fluid communication therebetween.

The accumulator may comprise a container and/or a mouth. In embodiments, the mouth may provide the inlet and at least one outlet. The mouth may be in an upper or lower portion of the accumulator or container. The accumulator or container may describe or define a space for storing a pressurised fluid, e.g. water and/or air. The inlet or mouth may be fluidly connected between the inlet of the control circuit and the operating valve, e.g. such that pressurised fluid introduced therein from the source compresses air within the container to provide a pressurised store of water.

The flushing device may, but need not, comprise a syphon or any other suitable flushing device, such as a flush valve with a pivotable or retractable valve member or plug for selectively closing the outlet of a cistern. For example, the flushing device may comprise a flushing valve that is operable or configured to operate by hydraulic fluid pressure, such as the flush valve described in GB2488382.

Where the flushing device comprises a syphon, the syphon may have an inverted generally U shaped duct with an upleg and a downleg. The syphon may comprise an open-ended chamber, which may be fluidly connected to the upleg. The syphon may comprise a piston movable in the chamber. The actuator, e.g. of the control circuit, may be operatively connected to the piston, e.g. for moving the piston in the chamber to initiate a syphonic flushing action.

The syphon may comprise two, three or more parts that may be adjustable relative to one another. The syphon may comprise a part, e.g. a first part, having an evacuation tube with a lower end adapted to be mounted to the base of a cistern. The syphon may comprise a part, e.g. a second part, having a suction tube and an open-ended chamber, which may have a piston movable therein, e.g. by the actuator. The syphon may comprise a part, e.g. a third part, having an inverted generally U-shaped duct with an upleg portion and a downleg portion. The upleg portion and downleg portion of the U-shaped duct may each be mounted in telescopic relation with the suction tube and evacuation tube respectively.

The apparatus may comprise a manifold, for example an inlet manifold, which will be referred to hereinafter as an inlet manifold but this term may be replaced by the term manifold. The inlet manifold may include the inlet and/or an accumulator port, e.g. to which the accumulator is operatively and/or fluidly connected or coupled. The inlet manifold may include an outlet, e.g. a first outlet, to which the operating valve may be operatively and/or fluidly connected or coupled. The inlet manifold may comprise a second outlet, for example to which is fluidly connected or connectable a filling device, e.g. for refilling the cistern following a flushing event.

The inlet manifold may comprise a part, e.g. a first part, which may include the first outlet. The inlet manifold may comprise a part, e.g. a second part, which may include the second outlet. The second part may be movable relative to the first part, for example to enable the position of the fill device to be adjusted relative to the operating valve. The first part of the inlet manifold may mounted to, e.g. directly or indirectly, the open-ended chamber or second part of the syphon, e.g. for movement therewith.

At least part of the filing device may be mounted to, e.g. directly or indirectly, the second part for movement therewith. One or both of the operating valve and/or the accumulator may be mounted to, e.g. directly or indirectly, the first part.

The first and second parts may be telescopically adjustable relative to one another. The second part may be stepwise adjustable relative to the first part.

One of the parts, e.g. the first part, may comprise a rack, which may be mounted relative thereto or incorporated therein or otherwise associated therewith. The other part, e.g. the second part, may comprise a latch, which may be mounted relative thereto or incorporated therein or associated therewith. The latch may be for releasably engaging the rack, for example at one of a plurality of positions, e.g. to provide the step-wise adjustment. The teeth of the rack may lie at an angle relative, e.g. to the horizontal, such as for inhibiting inadvertent disengagement between the latch and the rack.

In embodiments, the rack is comprised in or mounted to another part of the flushing apparatus, for example one of the parts of the syphon or the actuator. The actuator may comprise an actuator piston, which may be movable within an actuator chamber. The actuator chamber may be mounted to, e.g. directly or indirectly, the open-ended chamber or second part of the syphon, e.g. for movement therewith. The rack may be mounted to or formed on an outer surface of the actuator chamber. Thus, in embodiments where both the actuator chamber and the first part of the inlet manifold are mounted to the open-ended syphon chamber or the second part of the syphon, the rack may be fixed in position relative to both.

The accumulator may comprise a mouth, which may be mounted, coupled or secured and/or in fluid communication with the accumulator port. The mouth may be mounted, coupled or secured to the accumulator port by a bayonet fitting. The latch may be configured to inhibit disengagement of the mouth or bayonet fitting, for example when it is engaged with the rack.

The apparatus or control circuit may comprise a filling device, e.g. a cistern filling device. The filling device may comprise a float operated valve assembly. The filling device may comprise one or more of a valve, an arm, which may be pivotally mounted relative to the valve, and a float, which may be attached to the arm, e.g. at or adjacent a first end of the arm. The filling device may be configured such that when the float is in a raised position, a portion of the arm closes the valve, and/or when the float is in a lowered position, the valve is open.

The filling device may comprise a float chamber or reservoir, e.g. a delayed fill float chamber or reservoir, hereinafter float chamber. The float may be received or receivable within the float chamber. The float chamber may comprise an open top and/or a draining port in its base. The float may be movable within the float chamber and/or may extend through the open top thereof. In embodiments, the float chamber may comprise a deflector, lid or cover, for example to prevent or inhibit water from valve of the filling device from entering, in use, the float chamber. In such embodiments, the float chamber may comprise a side opening, which may be of variable size and/or configuration, for allowing water from within the cistern to enter the float chamber, e.g. as the water level rises to such opening.

The valve of the filling device may comprise an equilibrium valve, for example a diaphragm-type equilibrium valve, which may include a bleed port. The bleed port may be closed by the arm, e.g. the or a portion of the arm, e.g. when the float is in the raised position. The bleed port may be unobstructed by the arm when the float is in the lowered position.

The apparatus may comprise a coupling, e.g. for releasably coupling, in use, the inlet to the source. The coupling may include two or more parts, e.g. first and second parts, which may be releasably coupled together. The coupling may be upstream of the accumulator, for example to enable the control circuit to be releasably coupled to the source. The coupling may be operable or couplable manually or automatically, e.g. via a spring loaded mechanism.

The first part of the coupling may comprise a locking ring, which may include a series of inwardly extending radial teeth. The second part of the coupling may comprise a series of outwardly extending radial teeth. The locking ring may be movable between an uncoupled or unlocked position, e.g. in which the second part is insertable into the inlet, and/or a coupled or locked position, e.g. in which removal of the second part is prevented.

At least one of the first and second parts of the coupling may comprise a recess for receiving a filter, e.g. such that it is captivated between the first and second parts when they are coupled together. The first part may comprise a stepped recess, e.g. wherein the filter is configured to abut the step when the first and second parts are coupled together. The second part may comprise an annular recess within which an end or periphery of the filter is received. The apparatus may comprise a filter, e.g. received between the first and second parts of the coupling. The filter may comprise a conical filter, which may include a frame with a circular inlet corresponding to the mouth of the filter. The filter may comprise a seal, e.g. an O-ring seal, which may be received within a radial groove in the frame or between the circular inlet of the frame and a facing surface of the first and/or second parts.

The apparatus may comprise a push button actuator, which may be operatively connected to the control circuit, e.g. for operating the flushing device. The push button actuator may comprise push button mounted to a body, e.g. movably or actuatably mounted to the body. The push button actuator may comprise a surround with a recess, within which recess the body and/or the push button may be received. The surround, e.g. the recess of the surround, and the body may comprise cooperating radial features. The radial features may cooperate such that the push button is in a first position when the body and the surround are in a first relative radial orientation and/or is in a second position when the body and the surround are in a second relative radial orientation. The push button may be flush or stand proud of the surround in the first position. In the second position, the push button may be retracted relative to the first position.

The radial features of one of the surround or the recess of the surround and the body may comprise castellations. The radial features of the other may comprise spokes. The spokes may rest on or against the castellations, e.g. in the first relative orientation and/or between the castellations, e.g. in the second relative orientation. Preferably, the surround or recess of the surround comprises the castellations and the body comprises the spokes.

At least one or each castellation may comprise a recess, e.g. within which a respective one of the spokes is received in the first relative orientation. The recess may be formed by a pair of spaced projections.

The apparatus or control circuit or accumulator, for example the inlet manifold, may comprise one or more non-return means, e.g. one or more non-return valves, for preventing water from flowing back through the inlet toward the source. The non-return means may be associated with the inlet or fluid inlet, e.g. water inlet, and/or may be upstream of the accumulator. The non-return means may be configured or operable such that the pressure within the accumulator corresponds substantially to a peak pressure to which the control circuit is exposed. For example, by allowing pressurised fluid from the source to enter the accumulator, whilst inhibiting such fluid from flowing from the accumulator back toward the source, the non-return means enables the accumulator to store the pressurised fluid when fluid pressure from the source drops.

In embodiments, the non-return means may comprise an anti back-syphonage valve. In embodiments, the non-return means may comprise a valve member, which may be biased or resiliently biased to seat against a valve seat. The biasing force may be configured such that a back flow of pressure toward the inlet, for example from the inlet manifold or accumulator, causes the valve member to unseat and/or allow air to be introduced into the inlet or inlet manifold, e.g. thereby preventing a flow of water toward the source through the inlet.

Another aspect of the invention provides a cistern flushing apparatus comprising a flushing device for fluid connection with an outlet of a cistern, a hydraulically-driven control circuit for operating the flushing device, a filling device mounted to the flushing device for refilling the cistern following a flushing event and an inlet manifold with an inlet for fluid connection with a source of pressurised water, wherein the inlet manifold comprises first and second outlets coupled respectively to the filling device and the control circuit.

Yet another aspect of the invention provides a cistern flushing apparatus comprising a flushing device for fluid connection with an outlet of a cistern, a hydraulically-driven control circuit for operating the flushing device and a coupling for coupling an inlet of the control circuit to a pressurised water supply line, wherein the coupling comprises first and second parts releasably coupled together and a filter that is accessible and/or removable when the first and second parts are uncoupled.

A further aspect of the invention provides a control circuit for a cistern flushing apparatus. The control circuit may comprise any one or more features described above in relation to any of the aforementioned aspect.

A yet further aspect of the invention provides a control circuit for a cistern flushing apparatus, the control circuit comprising an inlet for fluid connection with a source of pressurised water, an outlet for fluid connection with the actuator of a flushing device, an operating valve fluidly connected between the inlet and the outlet and an accumulator fluidly connected between the operating valve and the inlet, wherein the accumulator is configured to supplement, in use, the flow of pressurised water supplied by the source to the outlet.

Yet another aspect of the invention provides a control circuit for a cistern flushing apparatus, the control circuit comprising an operating valve for selectively controlling the supply of pressurised water to the actuator of a flushing device, a filling device for refilling the cistern following a flushing event and an inlet manifold with an inlet for fluid connection with a source of pressurised water, wherein the inlet manifold comprises first and second outlets coupled respectively to the filling device and the control circuit.

Yet another aspect of the invention provides a control circuit for a cistern flushing apparatus, the control circuit comprising an inlet for fluid connection with a source of pressurised water, an outlet for fluid connection with the actuator of a flushing device, an operating valve fluidly connected between the inlet and the outlet and a coupling for coupling an inlet to a pressurised water supply line, wherein the coupling comprises first and second parts releasably coupled together and a filter that is accessible and/or removable when the first and second parts are uncoupled.

Yet another aspect of the invention provides a push button actuator for operating the flushing device, the actuator comprising a surround with a recess, a body received within the recess of the surround and a push button mounted to the body, wherein the recess of the surround and the body comprise cooperating radial features such that the push button is in a first position in which it is flush or stands proud of the surround when the body and the surround are in a first relative radial orientation and is in a second position in which it is retracted relative to the first position when the body and the surround are in a second relative radial orientation.

Other aspects of the invention provide a cistern comprising a flushing apparatus as described above, a toilet comprising such a cistern and a water closet installation comprising such a toilet.

Yet another aspect of the invention provides a method of installing a flushing apparatus, e.g. as described above.

Yet another aspect of the invention provides a method of manufacturing a flushing apparatus, e.g. as described above.

Yet another aspect of the invention provides a method of operating a flushing apparatus, e.g. as described above.

For the avoidance of doubt, any of the features described herein apply equally to any aspect of the invention. For example, the flushing apparatus may comprise any one or more features of the control circuit relevant thereto and vice versa. Similarly, the method may comprise any one or more features or steps relevant to one or more features of the flushing apparatus or the control circuit.

Another aspect of the invention provides a computer program element comprising and/or describing and/or defining a three-dimensional design for use with a simulation means or a three-dimensional additive or subtractive manufacturing means or device, e.g. a three-dimensional printer or CNC machine, the three-dimensional design comprising an embodiment of the aforementioned flushing apparatus or control circuit or any component thereof.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. For the avoidance of doubt, the terms "may", "and/or", "e.g.", "for example" and any similar term as used herein should be interpreted as non-limiting such that any feature so-described need not be present. Indeed, any combination of optional features is expressly envisaged without departing from the scope of the invention, whether or not these are expressly claimed. The applicant reserves the right to change any originally filed claim or file any new claim accordingly, including the right to amend any originally filed claim to depend from and/or incorporate any feature of any other claim although not originally claimed in that manner.

Embodiments of the invention will now be described by way of example only with reference to the accompanying drawings in which.

Figure 1:
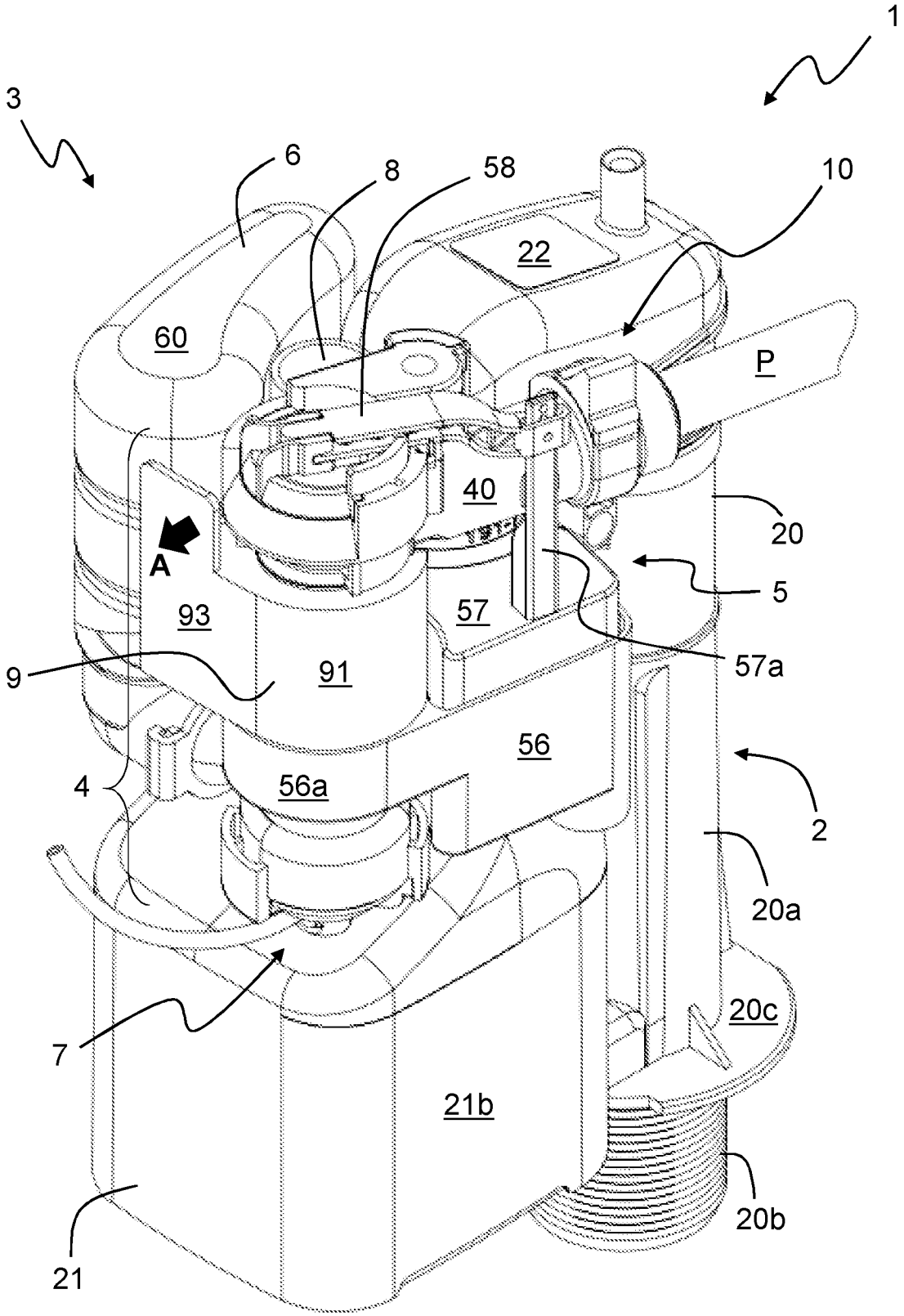
FIG. 1 is a perspective view of a flushing apparatus according to an embodiment of the invention.

Referring now to FIGS. 1 to 9, there is shown a cistern flushing apparatus 1 including a flushing device 2 for fluid connection with an outlet of a cistern (not shown) and an integrated hydraulic circuit 3 for operating the flushing device 2 and for filling a cistern (not shown) following a flushing event.

In this embodiment, the flushing device 2 is in the form of an adjustable syphon 2 similar to that which is disclosed in GB2486776, the entire contents of which are incorporated herein by reference. More specifically, the syphon 2 includes first, second and third parts 20, 21, 22 mounted in telescopic relation with one another to enable adjustment of the flush volume characteristics thereof. The first part 20 includes an evacuation tube 20*a* having a radial flange 20*c* and threaded portion 20*b* extending from the flange 20*c* for insertion through an outlet in the base of a cistern (not shown) to be secured thereto by a nut (not shown) in the normal way. The second part 21 includes a suction tube 21*a* and an open-ended chamber 21*b*. The third part 22 is in the form of an inverted generally U-shaped duct with an upleg portion 22*a* and a downleg portion 22*b*. The upleg portion 22*a* and downleg portion 22*b* of the U-shaped duct 22 are each mounted in telescopic relation with the suction tube 21*a* and evacuation tube 20*a* respectively.

The first part 20 also includes a pair of lugs 20*d* projecting laterally from its upper end each with a hole 20*e* therethrough. The second part 21 includes a flat bracket 21*d* projecting laterally from the upper end of the suction tube 21*a* and having a plurality of spaced holes 21*e* through its thickness. The third part 22 includes a chain of lugs 22*d* extending downwardly from the front of the bight of the U between the downleg and upleg portions 22*a*, 22*b* and having a plurality of vertically spaced holes 22*e* through its thickness. A releasable fastener 23 (shown in FIG. 4) including a pair of spaced pins extends through a pair of adjacent holes 20*e*, 21*e*, 22*e* in each of the first, second and third parts 20, 21, 22 to secure simultaneously the parts 20, 21, 22 together.

The first part 20 includes a longitudinally extending rib 20*f* and the second part 21 includes a bracket 21*f* with a keyway that receives the rib 20*f* of the first part. These features 20*f*, 21*f* together with the telescopic connection between the parts 20, 21, 22 enables guided adjustment in their relative positions, as is known from GB2486776.

Figure 5:
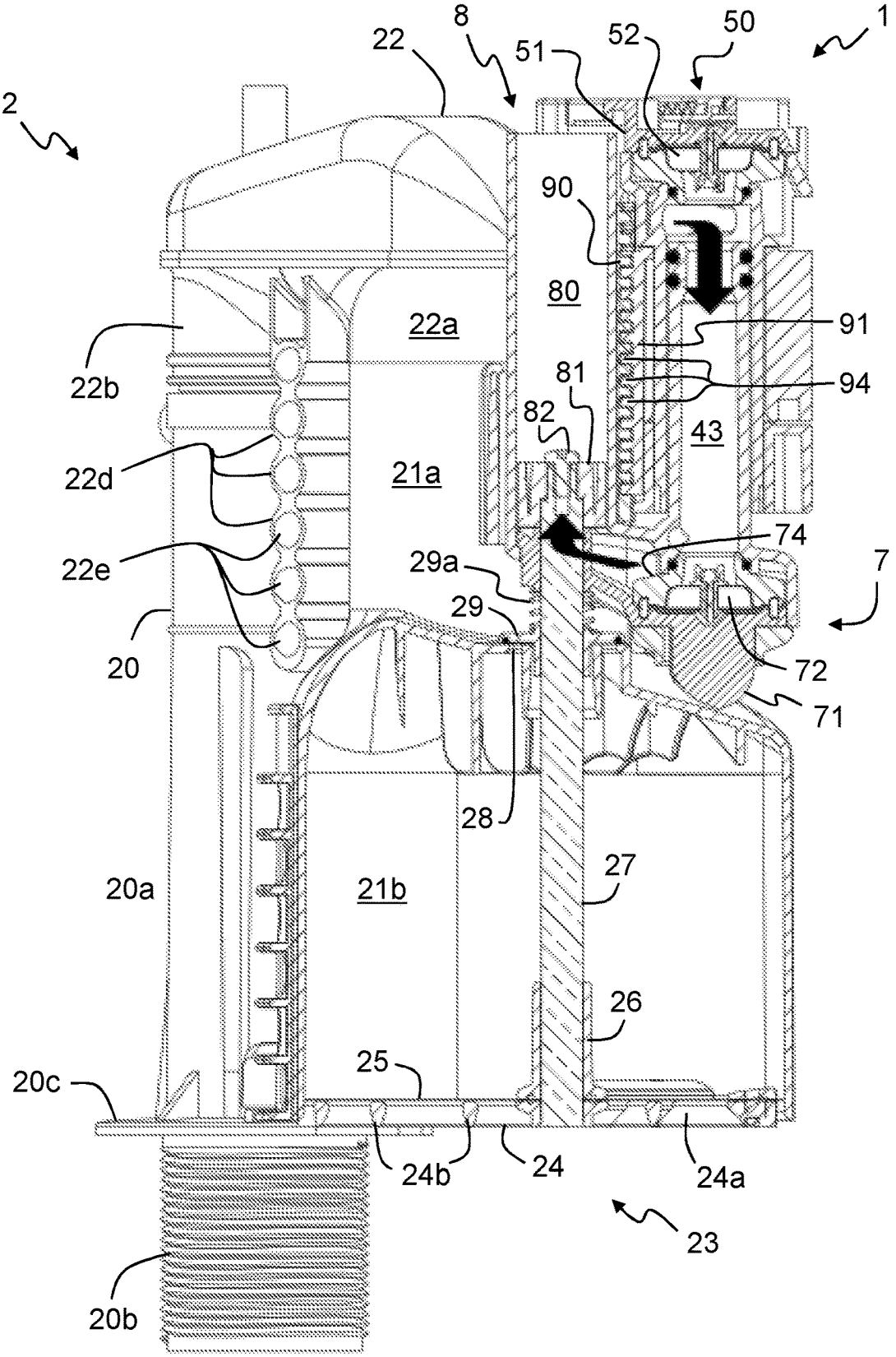
FIG. 5 is a partial section view of the apparatus of FIG. 1 illustrating the flow of pressurised water into the actuator of the flushing device.

Within the open-ended chamber 21*b* is a priming means in the form of a piston 23 including a frame 24 formed by a peripheral rim 24*a* with a series of ribs 24*b* extending between the sides of the rim 24*a* to provide a series of openings therebetween. The piston 23 also includes a flexible diaphragm 25 secured at the centre of piston 23 by a cylindrical rod mount 26 which receives and secures a piston rod 27. The piston rod 27 extends upwardly from the piston 23, through the top wall of the chamber 21*b* and is formed of a material having sufficient mass to urge, in use, the piston 23 back down toward its home position, as shown in FIG. 5. The top wall of the open ended chamber 21*b* also includes a series of openings 28 about the piston rod 27 and an inverted top-hat shaped sealing element 29 that surrounds the piston rod and is biased by a spring 29*a* against the top wall to cover and seal the openings 28. When the piston 23 is in a raised position, the rod mount 26 abuts the sealing element 29 and urges it against the spring bias to reveal the openings 28. Thus, a partial flush can be achieved by keeping the piston 23 in a raised condition, since the syphonic action is broken when the water level reaches the openings 28.

The integrated hydraulic circuit 3 includes a manifold 4, a filling device 5, an accumulator 6, an operating valve 7, a hydraulic actuator 8 and a telescopic lock 9. The manifold 4 includes an inlet part 40, which defines a horizontal inlet passage 41 and a vertical outlet chamber 42, and an extension part 43 received telescopically within the outlet chamber 42 of the inlet part 40, which defines an adjustable extension of the vertical outlet chamber 42. The extension part 43 of the manifold 4 includes a pair of radial grooves 44 at its upper end that receive respective O-ring seals for sealingly engaging the outlet chamber 42. The extension part 43 also includes an accumulator port 45 extending laterally from a lower end thereof and having a pair of flanges 46 forming opposed facing locking channels on either side of the accumulator port 45. The inlet part 40 includes a coupling 10 at the inlet end of the inlet passage 41, more of which later.

The filling device 5 includes a float-operated diaphragm-type equilibrium valve 50 in this embodiment. The valve 50 includes a two-part housing 51, a diaphragm 52 with a peripheral flange captivated between the two parts of the housing 51 and a flow restrictor pin extending through a hole through a central, enlarged valve member portion of the diaphragm 52. On a first side of the diaphragm 52, the housing 51 includes an inlet 53, a plurality of radial outlets 54 and a valve seat between the inlet 53 and outlets 54 against which the central portion of the diaphragm 52 seats when the valve 50 is in a closed condition. On a second side of the diaphragm 52, there is a control chamber defined between the diaphragm 52 and a facing portion of the housing 51 with a bleed port 55 extending from the control chamber through the housing 51. The valve 50 is mounted to the inlet part 40 of the manifold 4 such that the inlet 53 is coupled to and in fluid communication with the outlet chamber 42.

The filling device 5 also includes a float chamber or reservoir 56, a float 57 and a float arm 58, all of which are mounted to the inlet part 40 of the manifold 4. The float chamber 56 is in the form of an open top container with a draining port (not shown) in its base and a mounting bracket 56*a* which surrounds the lower end of the inlet part 40 that defines the outlet chamber 42. The float 57 in this embodiment is an open bottom container with an upstand 57*a* extending upwardly from the top of the container and having a series of holes through its thickness adjacent its upper end. The float arm 58 includes a resilient stop 58*a* at a first of its ends and a hole at a second of its ends for receiving a fastener that extends therethrough and into one of the holes of the upstand 57*a* of the float 57. The float arm 58 is pivotally mounted relative to the inlet part 40 intermediate its ends such that when the float 57 is in a raised position the stop 58*a* of the arm 58 closes the bleed port 55 of the valve 50 and when the float 57 is in a lowered position the bleed port 55 is open.

The accumulator 6 includes an inverted bottle 60 having a kidney shaped horizontal cross-section and a mouth 61 at its lower end that is threadedly engaged with a coupling adapter 62. The mouth 61 of the bottle 60 includes a radial recess about its outer surface within which is received an O-ring for providing a sealed connection between the bottle 60 and the coupling adapter 62. The coupling adaptor 62 defines a 90 degree elbow to provide a horizontal inlet to the accumulator 6 and includes a pair of flanges 63 on either side of the horizontal inlet to provide a bayonet fitting for receipt within the locking channels defined by the flanges 46 of the accumulator port 45.

Figure 9:
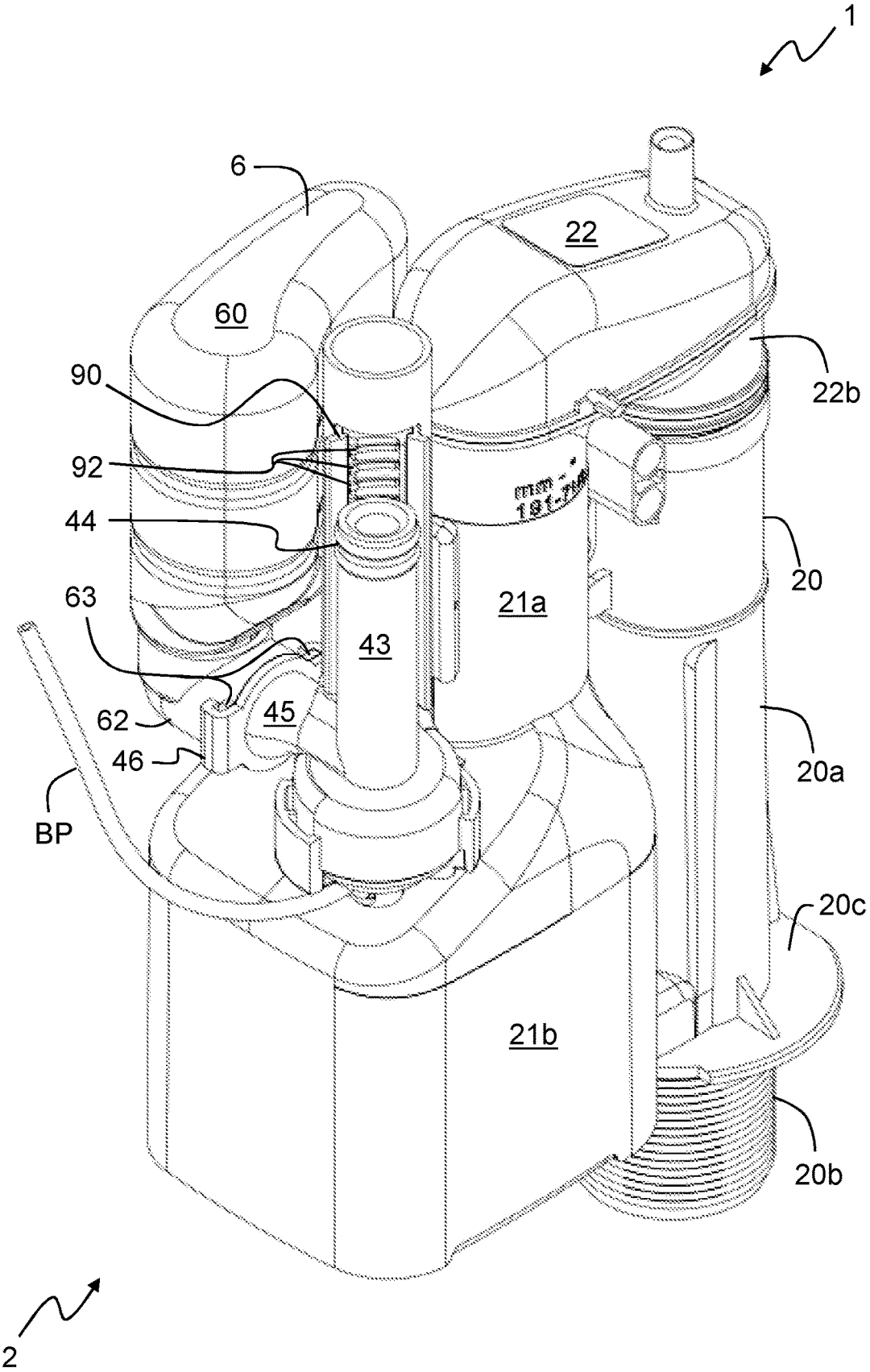
FIG. 9 is a perspective view of the apparatus of FIG. 1 with part of the integrated hydraulic circuit removed.
Figure 10:
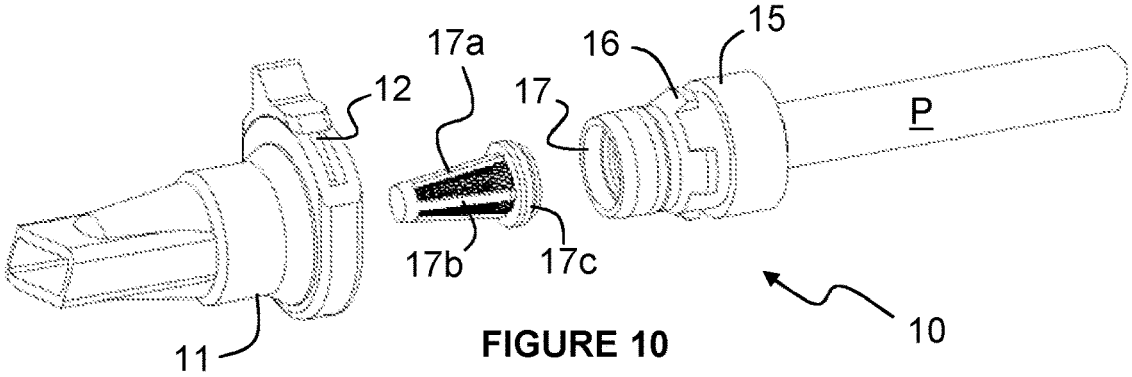
FIG. 10 is an exploded view of the inlet coupling of the apparatus of FIG. 1.
Figure 11:
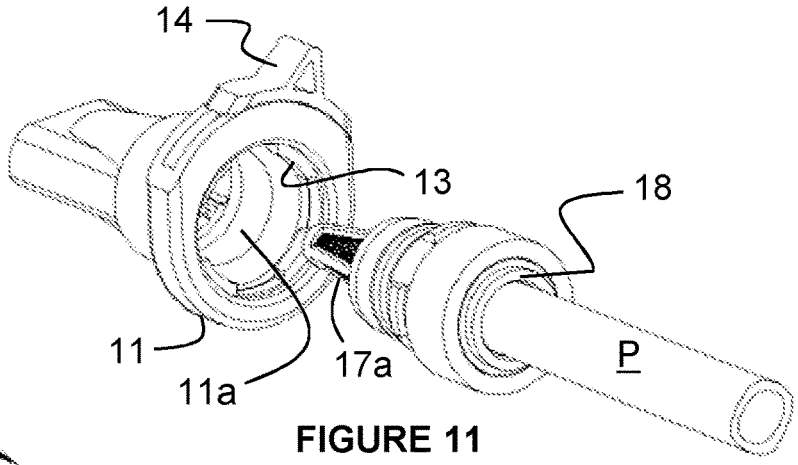
FIG. 11 is a partially assembled view of the inlet coupling of FIG. 10.
Figure 12:
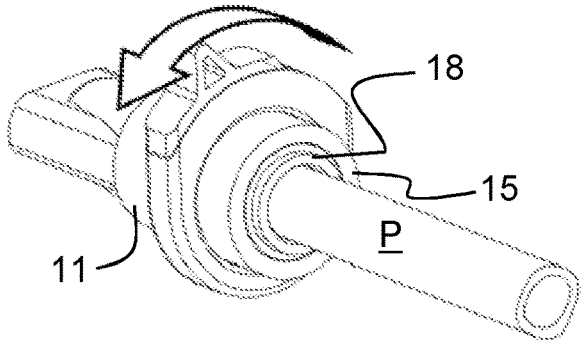
FIG. 12 is an assembled view of the inlet coupling of FIGS. 10 and 11.
Figure 13:
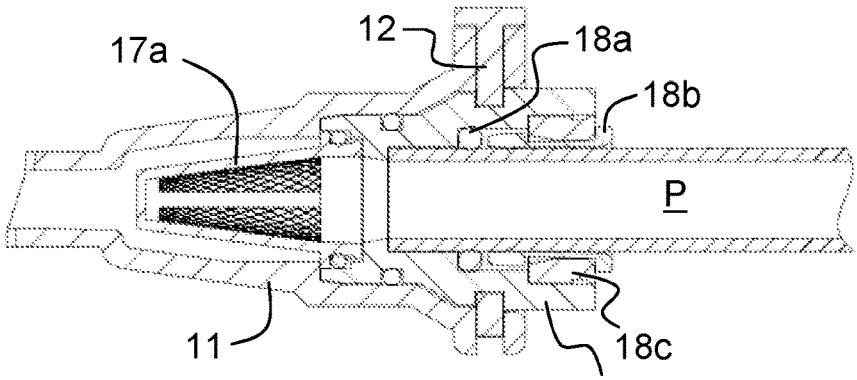
FIG. 13 is a section view of the assembled inlet coupling of FIG. 12.
Figure 14:
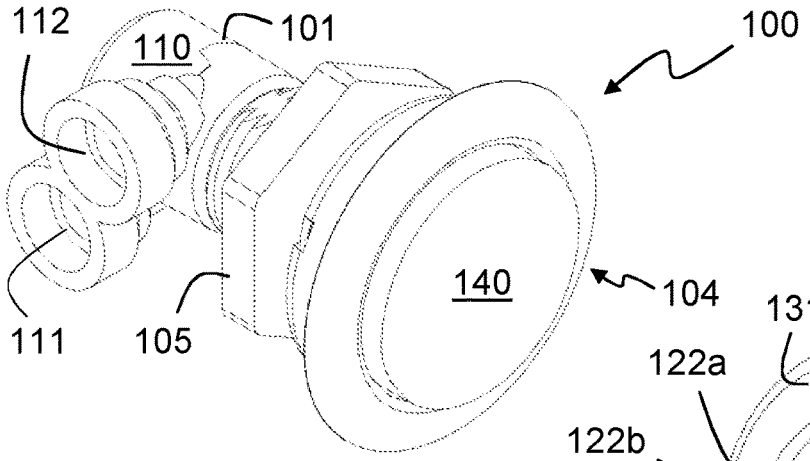
FIG. 14 is a perspective view of a push button actuator for connection with the operating valve of the apparatus of FIG. 1.
Figure 15:
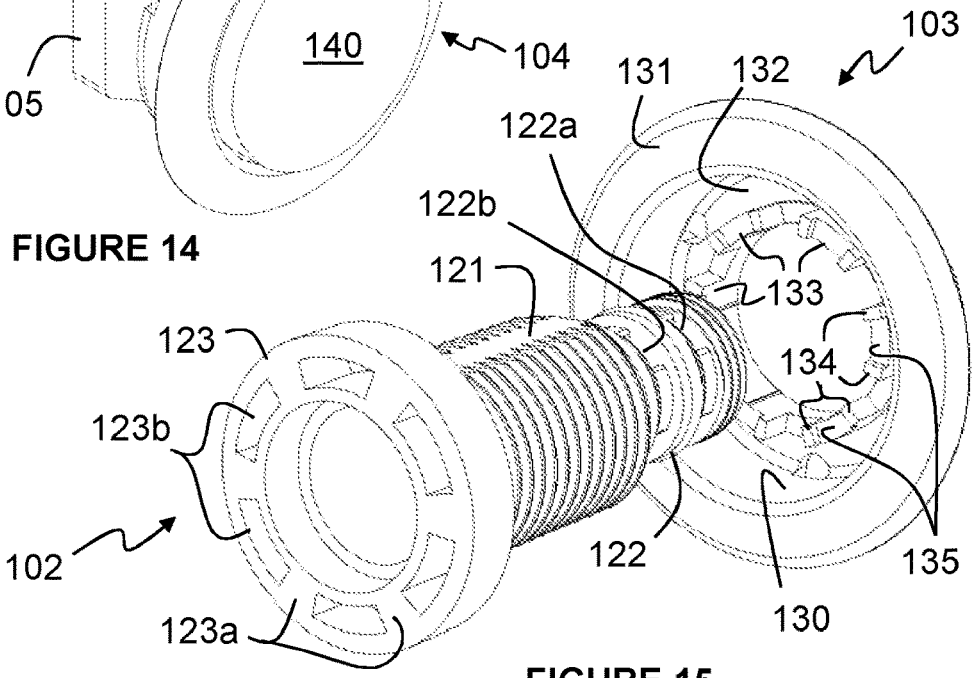
FIG. 15 is an exploded perspective view of the body and surround of the push button actuator of FIG. 14.

Referring to FIG. 9, the accumulator 6 is mounted to the accumulator port 45 by offering up the coupling adapter 62 with the bottle 60 oriented horizontally away from the syphon 2 such that the flanges 63 are oriented vertically, between the flanges 46 of the accumulator port 45. The accumulator 6 is then rotated upwardly to the orientation shown in FIG. 9 such that the flanges 63 are received within the locking channels defined by the flanges 46 of the accumulator port 45. In this orientation, the inlet of the accumulator 6 is lowermost such that pressurised fluid introduced therein from the source compresses air within the container to provide a pressurised store of water.

The operating valve 7 is similar to the valve 50 of the filling device 5, but rather than being float-operated it is operated by a separate push button actuator 10 (shown in FIGS. 14 to 18). The valve 7 includes a two-part housing 71, a diaphragm 72 with a peripheral flange captivated between the two parts of the housing 71 and a flow restrictor pin extending through a hole through a central, enlarged valve member portion of the diaphragm 72. On a first side of the diaphragm 72, the housing 71 includes an inlet 73, a plurality of radial outlets 74 and a valve seat between the inlet 73 and outlets 74 against which the central portion of the diaphragm 72 seats when the valve 7 is in a closed condition. On a second side of the diaphragm 72, there is a control chamber defined between the diaphragm 72 and a facing portion of the housing 71 with a bleed port 75 extending from the control chamber through to a push fit fitting 76 in the housing 71. Attached to the push fit fitting 76 is a bleed pipe BP operatively connected to the push button actuator 10. The operating valve 7 is mounted to the extension part 43 of the manifold 4 such that the inlet 73 is coupled to and in fluid communication with the outlet chamber 42.

The hydraulic actuator 8, shown more clearly in FIG. 5, includes an actuator cylinder 80 formed integrally with the extension part 43 of the manifold 4 and an actuator piston 81 reciprocable within the cylinder 80. The actuator piston 81 includes a hole within which the upper end of the piston rod 27 is received and secured by a screw 82. The bottom end of the actuator cylinder 80 is fed by the outlets 74 of the operating valve 7 and the top end of the actuator cylinder 80 is open. In this embodiment, the actuator piston 81 is sized and dimensioned such that a fluid flow entering the actuator cylinder 80 from below forces the actuator piston 81 upwardly within the actuator cylinder 80. The actuator piston 81 is also sized and dimensioned such that the clearance between the actuator piston 81 and the cylinder 80 permits some fluid to flow therebetween. Thus, in the absence of fluid flow entering the actuator cylinder 80 from the operating valve 7 the mass of the piston rod 27 urges fluid flow around the actuator piston 81 and lowering the syphon piston 23 back to its home position. In this embodiment, the actuator piston 81 is formed of a plastics material having a relatively low weight.

The telescopic lock 9 includes a rack 90 (shown more clearly in FIGS. 5 and 9) and a cooperating latch 91. The rack 90 is secured to the outside of the actuator cylinder 80 and includes a series of teeth 92 that extend substantially horizontally to define gaps therebetween. The latch 91 surrounds the inlet part 40 that defines the vertical outlet chamber 42 of the manifold and is rotatably captivated between the horizontal inlet passage 41 and the mounting bracket 56*a* of the float chamber 56. The latch 91 also includes a flat handle 93 to enable its manipulation and a series of teeth 94 that extend parallel to the teeth 92 of the rack 90 for engagement with the gaps between them. In this embodiment, the teeth 62, 63 lie at an angle relative to the horizontal so as to inhibit inadvertent disengagement between the latch 91 and the rack 90.

As depicted in FIG. 1, the handle 93 of the latch 91 holds the accumulator 6 in place by inhibiting its rotation in the reverse direction to that described above. The handle 93 may be rotated in direction A to release the teeth 94 of the latch 91 from those of the rack 90, thereby enabling the inlet part 40 of the manifold 4 to be moved up or down with respect to the extension part 43. It will be appreciated that the entire filling device 5 is mounted to and moves with the inlet part 40, thereby enabling adjustment of the position of the filling device 5 relative to the bight of the U of the third part 22 of the syphon 2. It will also be appreciated that this position alters the fill volume of the cistern, since the float chamber 56 and float 57 are also moved.

Thus, in order to increase the flush volume of the cistern, the third part 22 of the syphon 2 may be raised relative to the first and second parts 20, 21 and the inlet part 40 of the manifold may then be raised by a similar distance together with the filling device 5.

Accordingly, the invention provides an integrated flushing and filling apparatus 1 that is adjustable to alter the flushing characteristics with minimal effort. In a conventional arrangement, such adjustment would require both an adjustable flushing device 2 and an adjustable filling device 5, which are not always present and, in any event, their independent adjustment would be more cumbersome.

Figure 7:
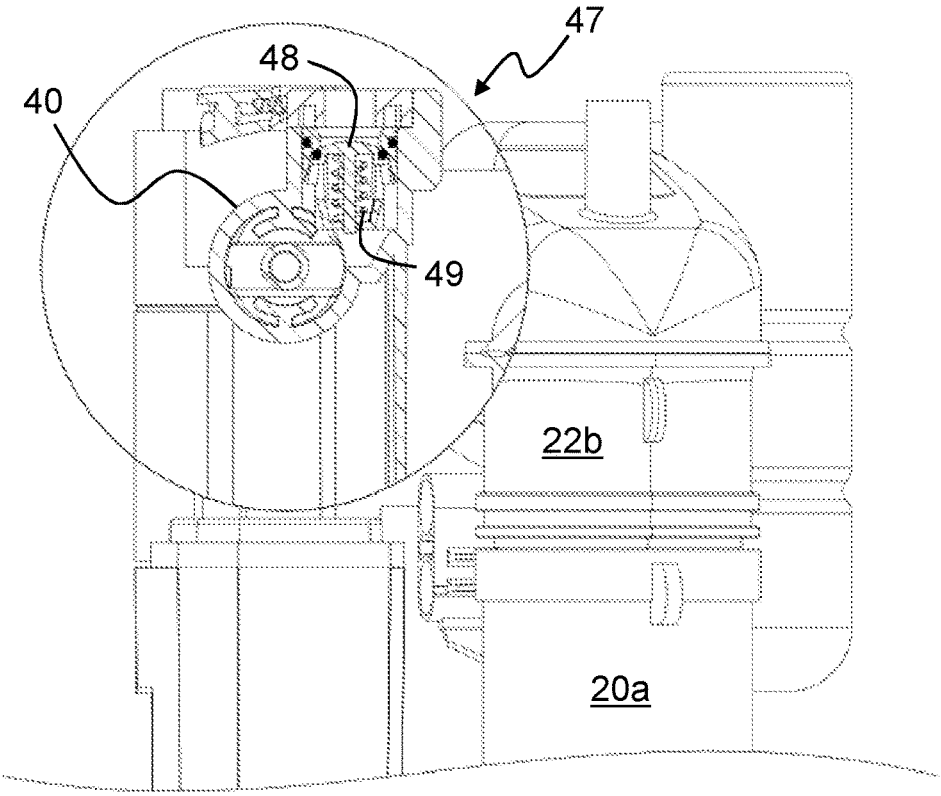
FIG. 7 is a partial section view of apparatus of FIG. 1 illustrating the air valve for the prevention of backflow.
Figure 8:
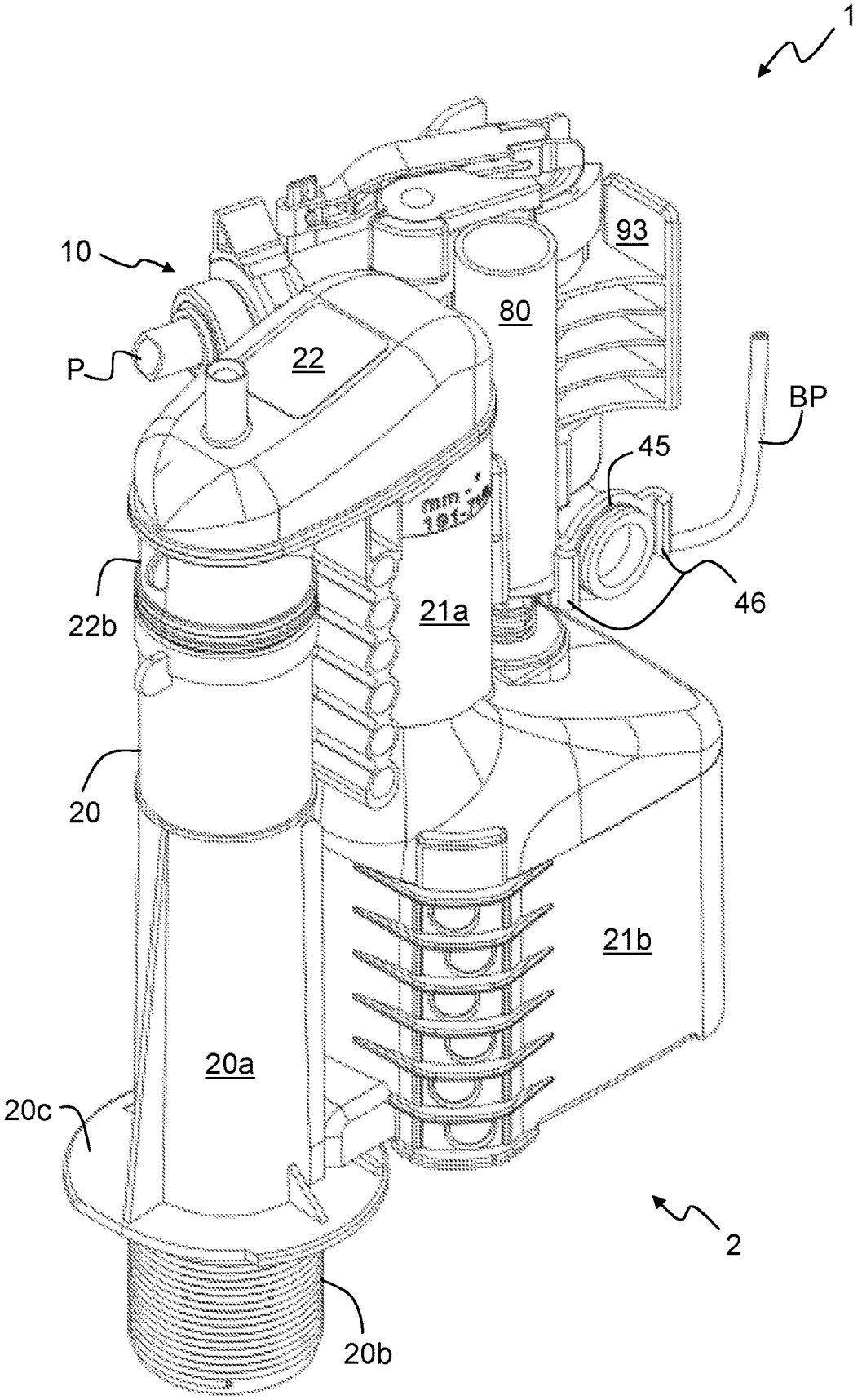
FIG. 8 is a perspective view of the apparatus of FIG. 1 with the accumulator removed.

As shown more clearly in FIG. 7, the inlet part 40 of the manifold 4 also includes an anti back-syphonage valve 47 in the form of a non-return air valve 47. The non-return valve 47 includes a valve member 48 with a dome-shaped head carrying an O-ring that is biased by a spring 49 to seat against a valve seat. The force of the spring 49 is configured such that a back flow of pressure toward the supply pipe P from the manifold 4 causes the valve member 48 to unseat and allow air to be introduced into the manifold, thereby preventing a flow of water from the outlet chamber 42 and extension part 43 back into the supply pipe P.

Referring now to FIGS. 10 to 13, the inlet coupling 10 is shown in greater detail. The inlet coupling 10 includes a first part 11 with a locking ring 12 having a series of inwardly extending radial teeth 13 and a triangular handle 14 for rotating the locking ring 12 between coupled and uncoupled orientations. The coupling 10 also includes a second part 15 with a series of outwardly extending radial teeth 16 each having a lead-in to facilitate insertion into the first part 11. The first part 11 includes a stepped recess 11*a* downstream of the locking ring 12. The second part 15 includes a filter recess 17 at its leading end, a push fit fitting 18 at its trailing end and an O-ring seal 19 received in a radial groove intermediate its ends which seals the second part 15 within the first part 11.

The push fit fitting 18 includes an O-ring seal 18*a* for sealing against a supply pipe P received by the push fit fitting 18, a collapsible collar 18*b* and a retaining ring 18*c* surrounding the collapsible collar 18*b*. The collapsible collar

18*b* and retaining ring 18*c* have cooperating tapered surfaces such that the collapsible collar 18*b* is compressed on attempted removal, thereby retaining the supply pipe P within the push fit fitting 18.

The coupling 10 also includes a conical filter 17*a* having a frame 17*b* with a circular inlet portion 17*c* corresponding to the mouth of the filter 17*a* and an O-ring seal 17*d* received within a radial groove in the circular inlet portion 17*c* which seals against a facing surface of the filter recess 17 of the second part 15 of the coupling 10. In the uncoupled orientation of the locking ring 12, the second part 15 is insertable into the first part 11 with its teeth 16 passing through the gaps between the teeth 13 of the first part 11. In the coupled orientation of the locking ring, the teeth 13, 16 of the first and second parts 11, 15 are aligned and removal of the second part 15 from the first part 11 is prevented.

Referring now to FIGS. 14 to 17, there is shown a push button actuator 100 for operating the syphon 2. The push button actuator 100 in this embodiment includes a manifold 101, a body 102, a surround 103, a push button 104 and a hexagonal securing nut 105 with an internal thread. The manifold 101 includes an internally threaded hollow cylinder 110 with an open end and a closed end, a radial inlet port 111 and a radial outlet port 112. Each of the inlet and outlet ports 111, 112 includes a push fit fitting for releasably securing and sealingly receiving a flexible tube (not shown). In this embodiment, the bleed pipe BP connected to the bleed port 75 of the operating valve 7 is configured to be connected to the inlet port 111 and a further pipe (not shown) is configured to connect to the outlet port 112 at one end and feed into the cistern (not shown) at the other end.

The body 102 is in the form of a hollow cylinder with a central, threaded section 121, a tail section 122 of reduced diameter, also externally threaded, and a mounting flange 123 at the opposite end of the body 102 to the tail section 122. The tail section 122 includes radial inlet passageways 122*a* and radial outlet passageways 122*b* axially spaced from the inlet passageways 122*a*. The mounting flange 123 includes a series of radial spokes 123*a* separated by axial holes 123*b* about the mounting flange 123.

The surround 103 is in the form of a hollow cylinder 130 with an outwardly extending radial flange 131 at one end and an inwardly extending radial flange 132 at the other end to form a base ring 132 of the surround. The base ring 132 includes a series of castellations 133 extending about its innermost edge. Each castellation 133 includes a pair of projections 134 at its outermost corners, which together define a recess 135.

The push button 104 includes a dome-shaped head 140 and a stem 141 movably received within the body 102. The push button 104 is movable within the body 102 between a deployed position shown in FIGS. 14, 16 and 17 and an actuated or depressed position in which the stem 141 is pushed further into the body 102. In this embodiment, fluid communication between the inlet passageways 122*a* and the outlet passageways 122*b* is closed in the deployed position and open in the actuated or depressed position. The push button 104 is also biased by a spring 142 to the deployed position. Thus, water is prevented from flowing from the inlet passageways 122*a* to the outlet passageways 122*b* until the push button 104 is operated. On operation of the push button 104, water is able to bleed from the bleed port 75 through the push button actuator 100 and back into the cistern (not shown) through the aforementioned pipes.

In an assembled condition, the body 102 is received within the surround 103 such that the mounting flange 123 of the body 102 engages the base ring 132 of the surround 103 and the securing nut 105 is threadedly engaged with the central section 121 of the body 102. In addition, the tail section 122 of the body 102 is received within and threadedly engaged with the cylinder 110 of the manifold 101 such that the inlet passageways 122*a* are aligned with the radial inlet port 111 and the outlet passageways 122*b* are aligned with the radial outlet port 102.

Figure 16:
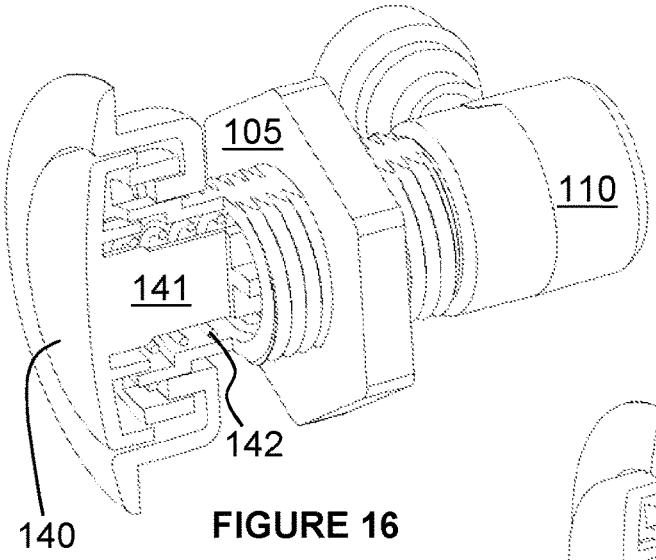
FIG. 16 is a partial section view of the push button actuator of FIG. 14 with the push button shown in a flush position.
Figure 17:
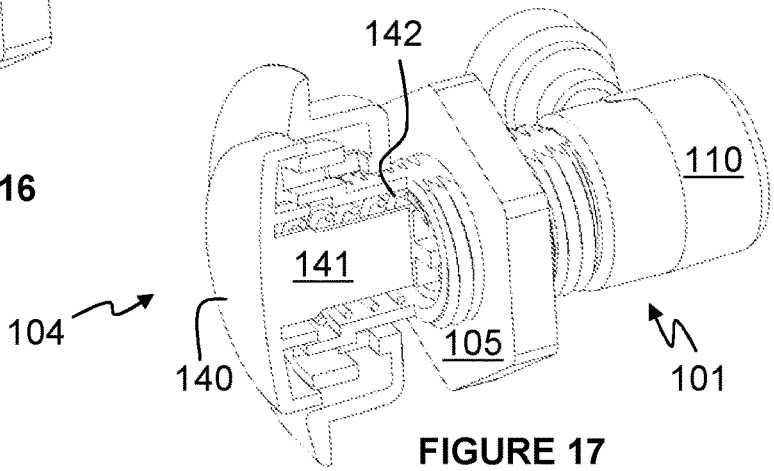
FIG. 17 is a partial section view similar to that of FIG. 16 in which the push button is shown in a proud position.

As illustrated in FIG. 16, when the body 102 is in a first orientation the castellations 133 of the surround 103 are received within axial holes 123*b* between the radial spokes 123*a* of the body 102 and the push button 104 is substantially flush with the outwardly extending radial flange 131 of the surround 103. As illustrated in FIG. 17, when the body is in a second orientation, the radial spokes 123*a* of the body 102 rest on the castellations 133 within the recesses 135 between the projections 134 and the push button 104 stands proud with respect to the outwardly extending radial flange 131 of the surround 103.

Thus, the push button actuator 100 may be adapted to suit the requirements of multiple different installations. For example, the arrangement of FIG. 16 may be desirable for aesthetic purposes, whilst the arrangement of FIG. 17 enables users with less dexterity to operate the push button actuator 100 with ease.

Figure 2:
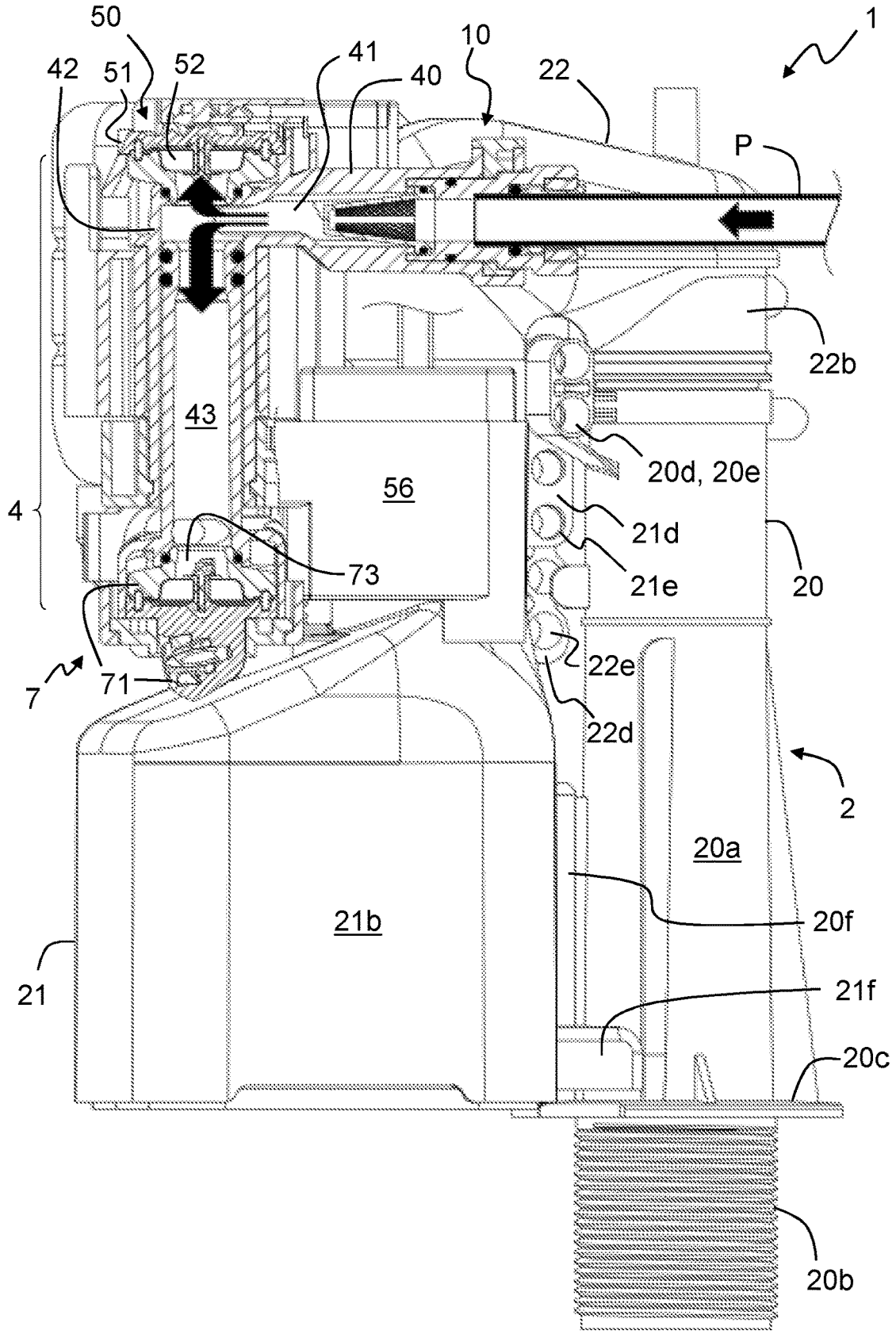
FIG. 2 is a partial section view of the apparatus of FIG. 1 illustrating the flow of pressurised water through the manifold.
Figure 3:
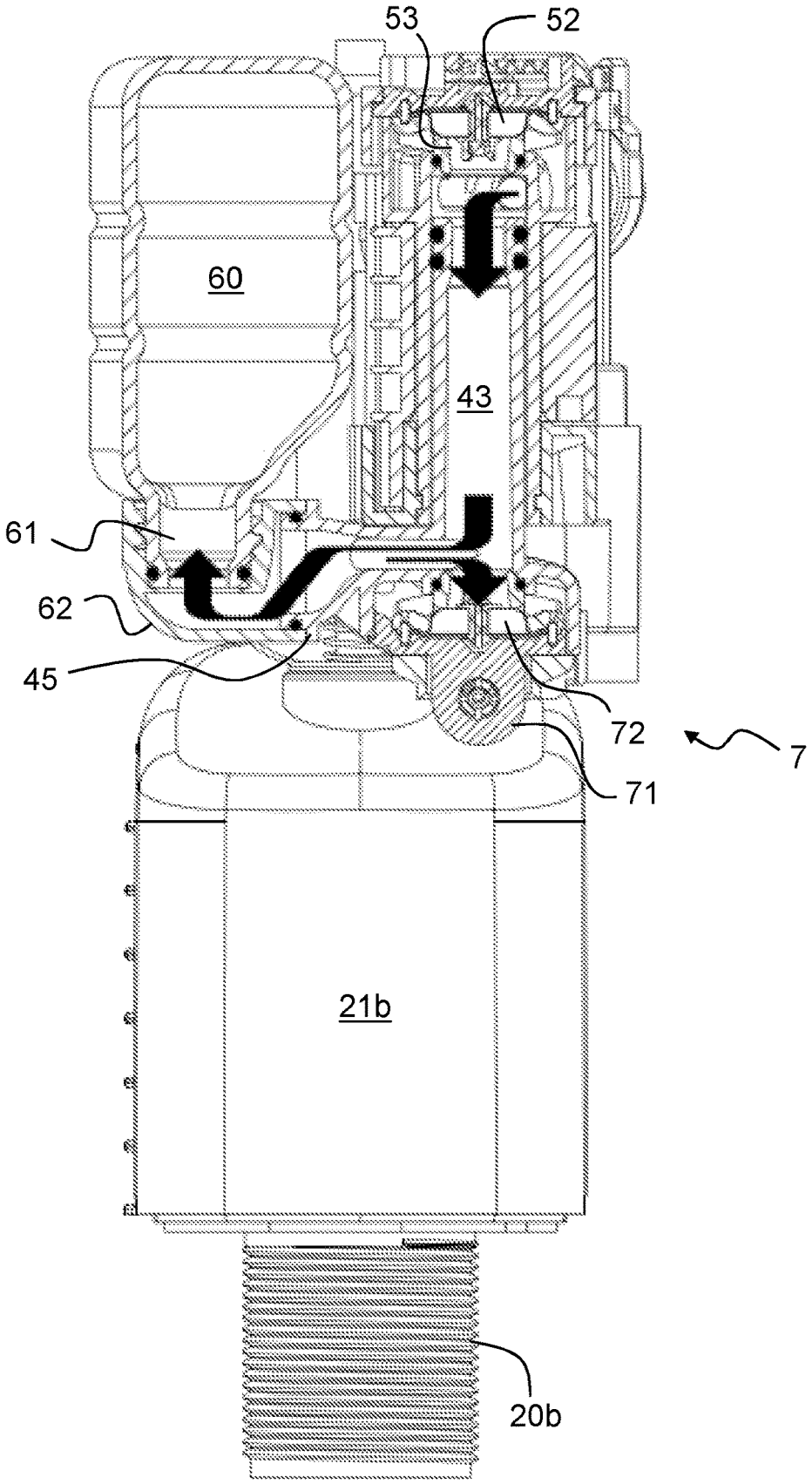
FIG. 3 is a partial section view of the apparatus of FIG. 1 illustrating the flow of pressurised water into and out of the accumulator.
Figure 4:
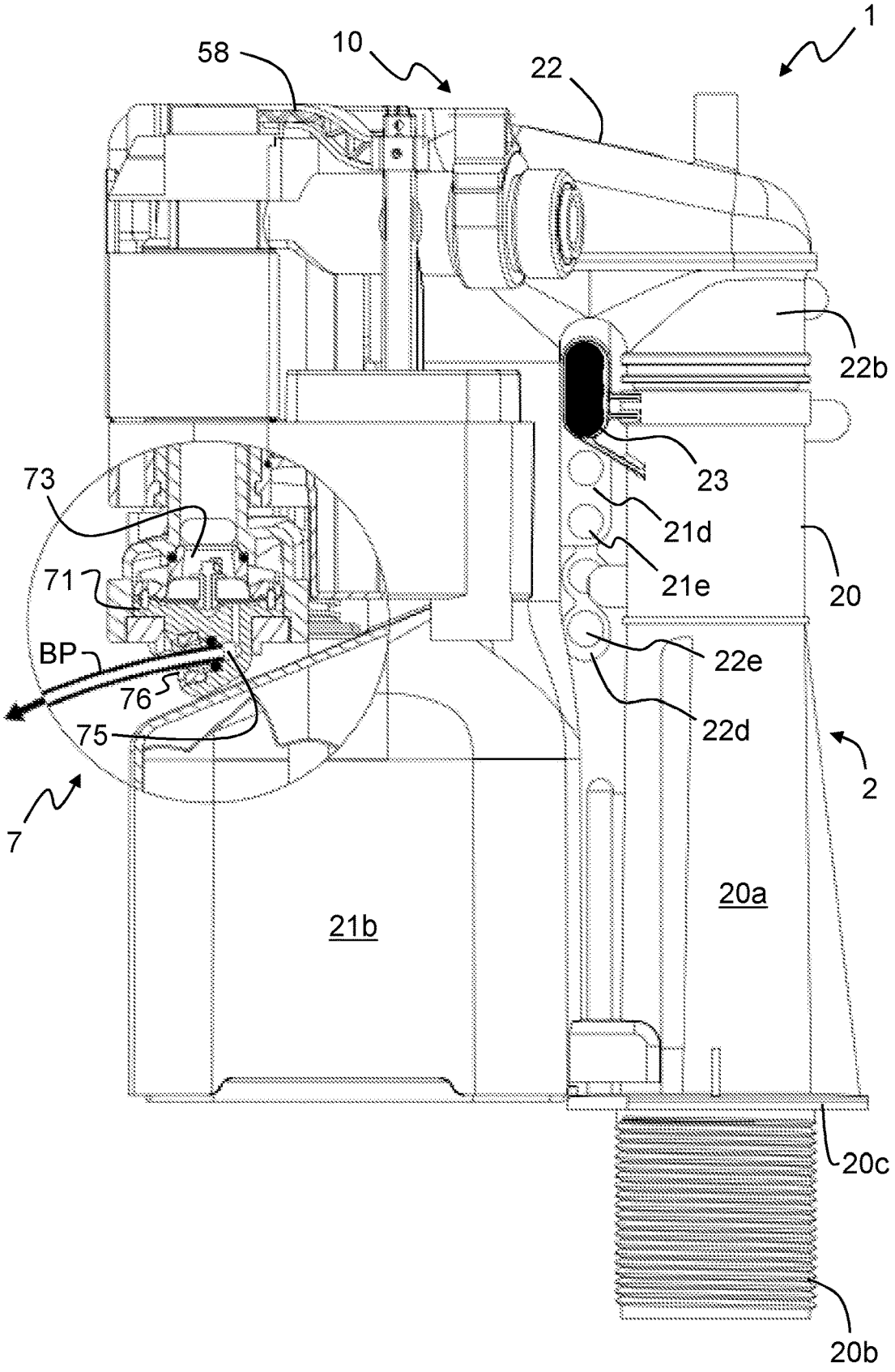
FIG. 4 is a partial section view of the apparatus of FIG. 1 illustrating the operating valve.

In use and as shown in FIGS. 2 and 3, when the supply pipe P is connected to a source of pressurised water, such pressurised water flows through the supply pipe P, through the filter 17*a*, into the manifold 4, into the inlet 53 of the fill valve 50, into the inlet 73 of the operating valve 7 and into the accumulator 6. When the cistern (not shown) is full, the arm 58 of the filling device 5 is raised, thereby blocking the bleed port 55 of the fill valve 50, pressurising the control chamber defined between the diaphragm 52 and a facing portion of the housing 51 and forcing the diaphragm 52 against the valve seat to close the fill valve 50. With the push button actuator 100 in the deployed position, the bleed port 75 of the operating valve is also blocked, thereby pressurising the control chamber defined between the diaphragm 72 and a facing portion of the housing 71 and forcing the diaphragm 72 against the valve seat to close the operating valve 7. Pressurised water then charges the accumulator 6 ready for operation.

In order to initiate a flush, the head 140 of the push button actuator 100 is depressed, which opens fluid communication between the inlet 111 and the outlet 112, thereby allowing flow from the bleed port 75 of the operating valve 7 through the bleed pipe BP and through the push button actuator 100 into the cistern (not shown). This flow releases the pressure within the control chamber of the operating valve 7 and the pressure within the manifold 4 unseats the diaphragm 72. Water then flows as illustrated in FIG. 5 from both the supply pipe P and from the accumulator 6 through the outlets 74 of the operating valve 7 and into the actuator cylinder 80, thereby forcing the actuator piston 81 upwardly and forcing the syphon piston 23 upwardly within the syphon chamber 21*b*. This forces the diaphragm 25 against the frame 24 of the piston 23 and raises the volume of water within the chamber 21*b* up and over the bight of the U of the third part 22 of the syphon 2 and initiating a syphonic flushing action. Water then flows through the openings in the frame 24 of the piston 23, urging the diaphragm 25 upwardly, and continues to flow through the syphon 2.

Thus, in situations where the pressure from the water supply is reduced or fluctuates, the accumulator 6 provides additional pressurised flow to ensure that the syphonic action is initiated effectively.

If the head 140 of the push button actuator 100 continues to be depressed, water continues to flow through the actuator cylinder 80 and retains the piston in a raised position. As outlined above, this also keeps the sealing element 29 in a raised condition exposing the series of openings 28 such that when the water level within the cistern (not shown) drops to this point the syphonic action is broken, thereby resulting in a partial flush. If, however, the head 140 of the push button actuator 100 is released immediately or shortly after it is depressed initially, a full flush is effected.

Figure 6:
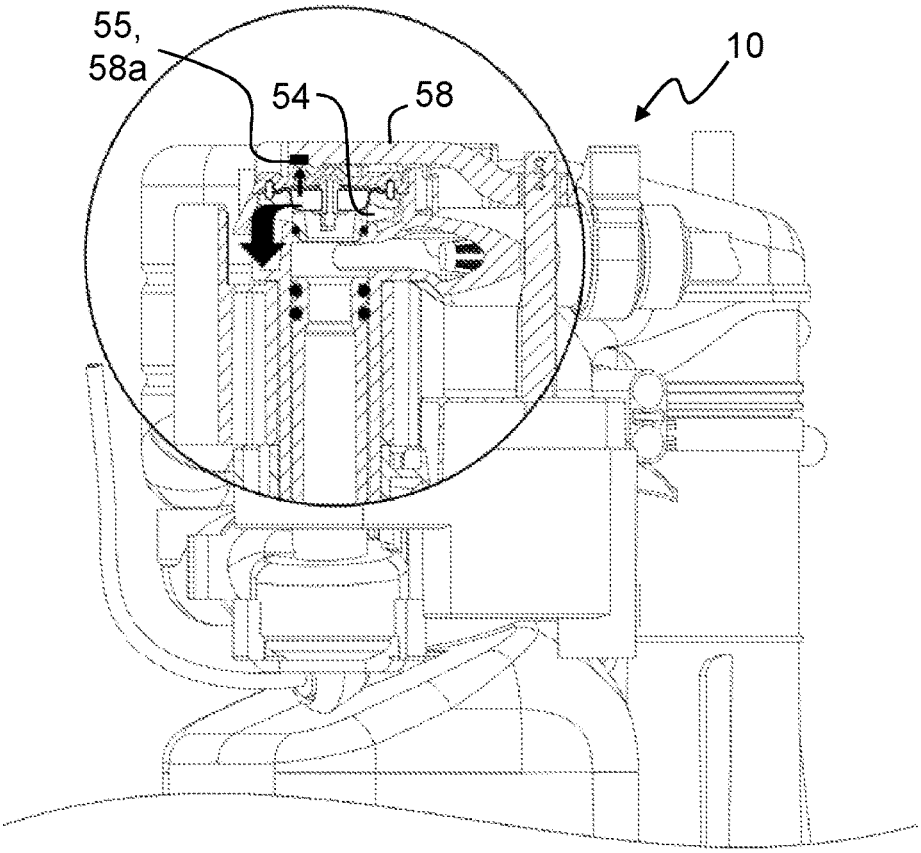
FIG. 6 is a partial section view of the apparatus of FIG. 1 illustrating the operation of the fill device.

As the water level within the cistern (not shown) drops, the float chamber 56 empties through the draining port (not shown) and the float 57 drops within the float chamber 56. At this point, the arm 58 pivots and the resilient stop 58*a* unseats from the bleed port 55, thereby releases the pressure within the control chamber of the float valve 50 and unseating the diaphragm 52. Fluid flow is then opened between the inlet 53 and the outlets 54 and water drains out of the float valve 50 as illustrated in FIG. 6 to refill the cistern (not shown). As the water level rises above the top of the float chamber 56, it is refilled and the float 57 is once again raised to cause the resilient stop 58*a* to block the bleed port 55, thereby pressurising the control chamber of the float valve 50 and forcing the diaphragm 52 against the valve seat and closing the float valve 50.

Figure 18:
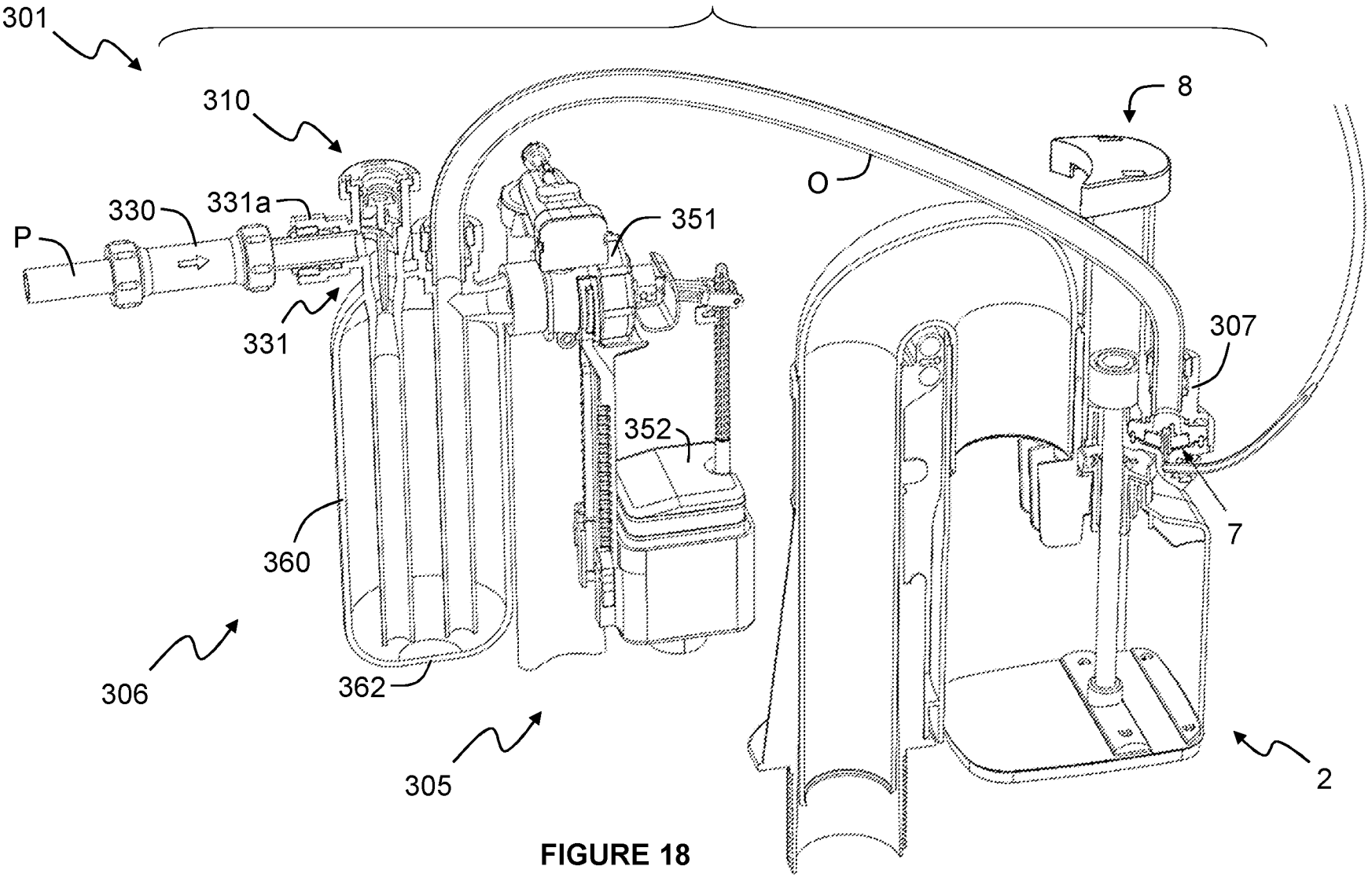
FIG. 18 is a perspective section view of a flushing apparatus according to another embodiment of the invention.
Figure 19:
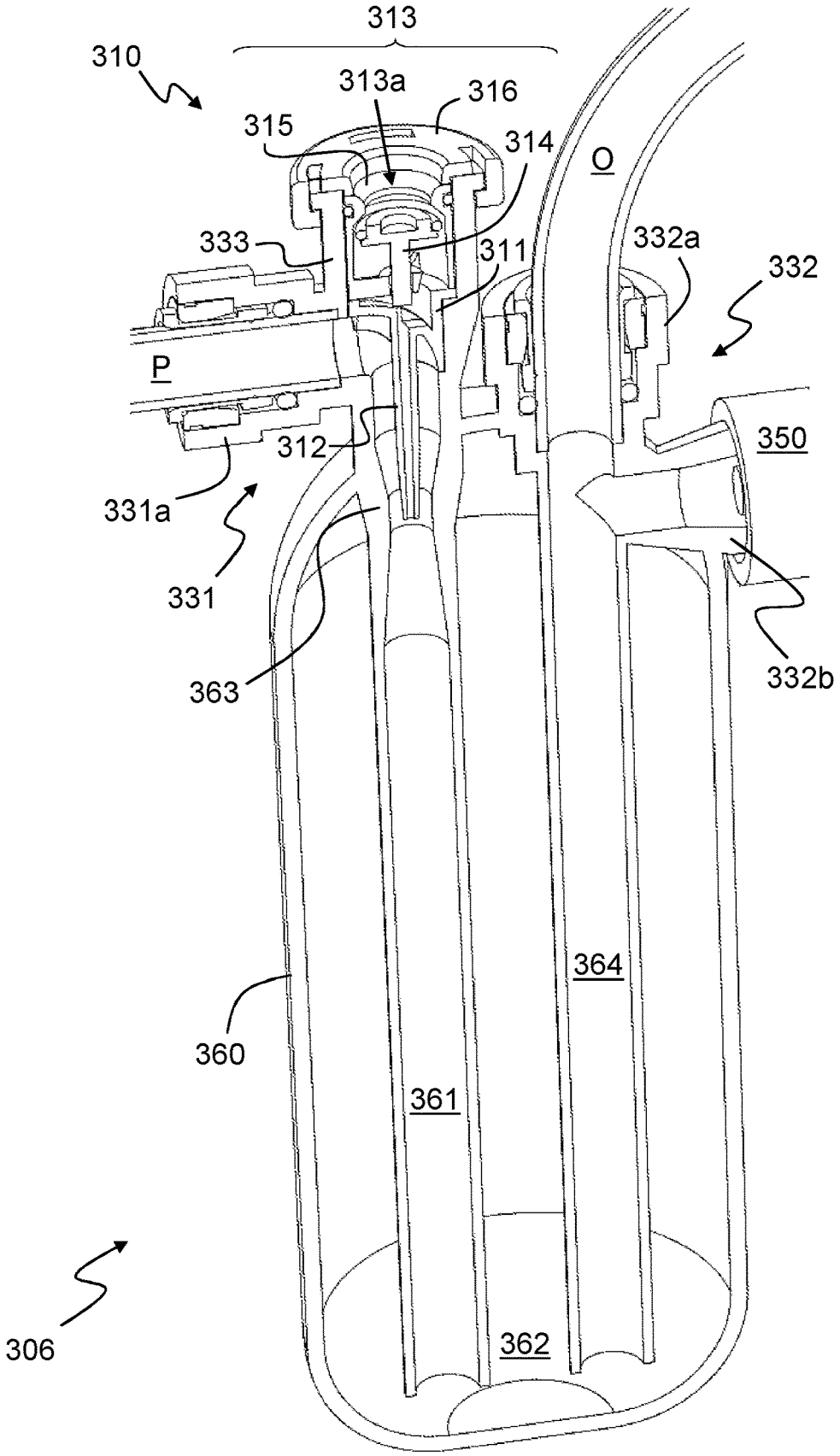
FIG. 19 is a perspective section view of the accumulator of the flushing apparatus of FIG. 18.

Turning now to FIGS. 18 and 19, there is shown a flushing apparatus 301 according to another embodiment of the invention. The flushing apparatus 301 according to this embodiment is similar to the flushing apparatus 1 described above, wherein like references depict like features that will not be described further herein. The flushing apparatus 301 according to this embodiment differs from the previous embodiment in that the hydraulic circuit 303 for operating the flushing device 2 is not integral with the flushing device 2 and it incorporates an air introduction assembly 310. In this embodiment, the hydraulic circuit 303 includes a supply pipe P incorporating a non-return valve 330, which feeds into an inlet manifold 331 via a push fit inlet fitting 331*a*. The hydraulic circuit 303 also includes an accumulator 306, an outlet manifold 332 and an outlet pipe O connecting an outlet push fit fitting 332*a* of the outlet manifold 332 to a push fit fitting 307 which feeds into the operating valve 7.

The accumulator 306 is in the form of a bottle 360 with which the inlet and outlet manifolds 331, 332 are both formed integrally at its mouth. The accumulator 306 includes a water inlet tube 361 fluidly connected to and extending orthogonally from the supply pipe P and push fit fitting 331*a* into the accumulator 306 toward its base 362. The water inlet tube 361 includes a necked portion 363, which accelerates, or throttles, the flow of water therethrough. The accumulator 306 also includes a water outlet tube 364 fluidly connected to and extending from the outlet manifold 332 into the accumulator 306 toward its base 362.

The inlet manifold 331 includes a third branch 333 receiving the air introduction assembly 310. The third branch 333 includes a flange at its upper end and receives an insert 311. The insert 311 includes a part-spherical shoulder for redirecting the inlet water flowing from the supply pipe P into the water inlet tube 361 and an air inlet tube 312 open at its upper end and extending into the necked portion 363 of the water inlet tube 361 to provide fluid communication between the third branch 333 and the necked portion 363.

The air introduction assembly 310 also includes a non-return valve 313, which includes an air inlet 313*a*, a valve member 314 reciprocable within a retainer 315. The valve member 314 includes a piston with an O-ring seal about its periphery and a longitudinal guide pin received within a guide ring in the base of the retainer 315 to ensure smooth reciprocating motion therein. The valve member 314 is retained within the retainer 315 by a shoulder at its upper end against which the piston seals when forced in its uppermost position. The retainer 315 is retained within the third branch 333 by a cap ring 316 which engages the flange of the third branch 333. The insert 311 is captivated between the retainer 315 and a shoulder of the inlet manifold 331.

The outlet manifold 332 includes a second outlet fitting 332*b*, which is in the form of a threaded tail in this embodiment. The apparatus 301 includes a filling device 305 having a threaded collar 350 for threadedly engaging the second outlet fitting 332*b* to provide a fluid connection therebetween. The filling device 305 is in the form of a substantially conventional fill valve 351 operated by a float 352, similar to that which is disclosed in EP0961892 and offered commercially by the present applicants, but for the means by which it connects to the outlet manifold 332 of the present invention.

In use and when the operating valve 7 and the fill valve 351 are both closed, the pressure within the accumulator 306 urges the valve member 314 against the shoulder of the retainer 315, thereby sealing off the non-return valve 313. When a user initiates a flushing action as described above in relation to the first embodiment, the operating valve 7 opens and pressurised water flows from the accumulator 306 through the outlet pipe O and through the operating valve 7 to initiate the symphonic action. This occurs even in the absence of fluid pressure from the source. Following operation, the operating valve 7 closes.

As the water level drops, the float 352 of the filing device 305 lowers and opens the fill valve 351 and water flows from the accumulator, out of the second outlet fitting 332*b* and out through the filling device 305. The flow of water from the supply pipe P through the water inlet tube 361 creates a venturi effect within the necked portion 363, thereby reducing the pressure within the third branch 333 of the inlet manifold 331. This reduction in pressure causes the valve member 314 to unseat from the shoulder of the retainer 315 and air is entrained from the air inlet 313*a* and into the accumulator 306. As outlined above, the applicants have observed that air in the accumulator may become depleted over time, but the air introduction assembly 310 regularly reintroduces air into the accumulator, thereby mitigating this phenomenon. The provision of an air inlet which introduces air through a venturi means enables this reintroduction of air to occur automatically.

As the water level rises, the float 352 rises and closes the fill valve 351. As a result, the circuit 303 pressurises and the accumulator refills, ready for the next flushing action.

It will be appreciated by those skilled in the art that several variations to the aforementioned embodiments are envisaged without departing from the scope of the invention. For example, although the invention has been illustrated with reference to a cistern flushing apparatus, it will be appreciated that it may be incorporated into any suitable fluid supply system, such as a drain cleaning apparatus, for example one which uses a jetting device. Whilst the accumulator in the specific embodiments is in the form of a bottle 60, 360, it will be appreciated that the accumulator may be provided by any enclosed volume, provided by, for example, multiple components assembled together to form a reservoir that is configured to function as described. It will also be appreciated by those skilled in the art that any number of combinations of the aforementioned features and/or those shown in the appended drawings provide clear advantages over the prior art and are therefore within the scope of the invention described herein.

The invention claimed is:

1. A toilet flushing apparatus comprising a flushing device for fluid connection with an outlet of a toilet cistern and a hydraulically-driven control circuit for operating the flushing device, the hydraulically-driven control circuit comprising a water inlet for fluidly connecting the control circuit to a source of pressurised water, a hydraulically-driven actuator comprising a cylinder and a piston disposed therein, an operating valve between the hydraulically-driven actuator and the water inlet for selectively opening fluid communication therebetween and an accumulator fluidly connected between the operating valve and the water inlet, wherein the accumulator is configured to supplement, in use, the flow of pressurised water supplied by the source to the actuator through the control circuit, the operating valve having an inlet fluidly connected to the accumulator and an outlet fluidly connected to a chamber in the cylinder, so that, when the operating valve is opened, pressurized fluid flows from the accumulator, through the operating valve, and into the cylinder chamber to drive the piston to operate the flushing device.

2. Apparatus according to claim 1 comprising an air inlet for introducing, in use, air into the accumulator.

3. Apparatus according to claim 2 comprising a venturi downstream of the water inlet, the venturi being in fluid communication with the air inlet for entraining air from the air inlet into the accumulator.

4. Apparatus according to claim 3 comprising an air inlet tube extending from the air inlet to or toward the venturi.

5. Apparatus according to claim 3 comprising a water inlet tube in fluid communication with the water inlet of the control circuit and with the accumulator, the water inlet tube comprising a restriction therein which provides, at least in part, the venturi.

6. Apparatus according to claim 5, wherein the water inlet tube extends into a base of the accumulator.

7. Apparatus according to claim 6 comprising a water outlet tube in fluid communication with a sump in the base of the accumulator.

8. Apparatus according to claim 2 comprising a non-return valve associated with the air inlet for allowing air to enter, in use, into the control circuit while inhibiting water egress therefrom.

9. A toilet cistern flushing apparatus comprising a flushing device for fluid connection with an outlet of a toilet cistern and a hydraulically-driven control circuit for operating the flushing device, the control circuit comprising a water inlet for fluidly connecting the control circuit to a source of pressurized water, a hydraulically-driven actuator, an operating valve between the actuator and the water inlet for selectively opening fluid communication therebetween and an accumulator fluidly connected between the operating valve and the water inlet, wherein the accumulator is configured to supplement, in use, the flow of pressurized water supplied by the source to the actuator through the control circuit, wherein the flushing device comprises a syphon having an inverted generally U shaped duct with an upleg and a downleg, an open-ended chamber fluidly connected to the upleg and a piston movable in the chamber, the actuator being operatively connected to the piston for moving the piston in the chamber to initiate a syphonic flushing action.

10. Apparatus according to claim 1, wherein the flushing device comprises a flush valve.

11. Apparatus according to claim 1 comprising a toilet cistern filling device in fluid communication with an outlet of the accumulator.

12. Apparatus according to claim 11, wherein the accumulator outlet in fluid communication with the toilet cistern filling device comprises a first outlet which bypasses the operating valve and the accumulator further comprises a second outlet in fluid communication with the hydraulically-driven actuator.

13. Apparatus according to claim 1 comprising a push button actuator operatively connected to the control circuit for operating the flushing device, the actuator comprising a surround with a recess, a body received within the recess of the surround and a push button mounted to the body, wherein the recess of the surround and the body comprise cooperating radial features such that the push button is in a first position in which it is flush or stands proud of the surround when the body and the surround are in a first relative radial orientation and is in a second position in which it is retracted relative to the first position when the body and the surround are in a second relative radial orientation.

14. Apparatus according to claim 1 wherein the piston is operatively connected to the flushing device.

15. Apparatus according to claim 1 wherein the flushing device is either an outlet valve or a syphon.

* * * * *